US006505841B1

(12) United States Patent
Kessler et al.

(10) Patent No.: US 6,505,841 B1
(45) Date of Patent: Jan. 14, 2003

(54) SPACER

(75) Inventors: Hansjürg Kessler, Braunwald (CH); Peter Martin, Freilassing (DE); Jürg Kunz, Bilten (CH); Gian-Paul Schmidt, Pontresina (CH)

(73) Assignee: Dakuga Holding Ltd., Bilten (CH)

( * ) Notice: Subject to any disclaimer, the term of this patent is extended or adjusted under 35 U.S.C. 154(b) by 0 days.

(21) Appl. No.: 09/857,079

(22) PCT Filed: Nov. 26, 1999

(86) PCT No.: PCT/CH99/00568

§ 371 (c)(1),
(2), (4) Date: Sep. 17, 2001

(87) PCT Pub. No.: WO00/32285

PCT Pub. Date: Jun. 8, 2000

(30) Foreign Application Priority Data

Dec. 1, 1998 (CH) ..... 2389/98

(51) Int. Cl.[7] ..... A63C 5/03

(52) U.S. Cl. ..... 280/14.22; 280/14.24; 280/14.21

(58) Field of Search ..... 280/601, 14.21, 280/14.22, 14.24, 14.26, 618, 634, 633

(56) References Cited

U.S. PATENT DOCUMENTS 5,188,386 A * 2/1993 Schweizer ..... 280/14.21
5,236,216 A * 8/1993 Ratzek ..... 280/14.21
5,913,530 A * 6/1999 Berger et al. ..... 280/14.21
5,915,718 A * 6/1999 Dodge ..... 280/14.21
6,022,041 A * 2/2000 Dailey et al. ..... 280/618
6,029,991 A * 2/2000 Frey ..... 280/613
RE36,800 E * 8/2000 Vetter et al. ..... 280/618
6,203,051 B1 * 3/2001 Sabol ..... 280/14.24
6,296,258 B2 * 10/2001 Higgins et al. ..... 280/14.22
6,318,749 B1 * 11/2001 Eglitis et al. ..... 280/607
6,450,511 B1 * 9/2002 LaVoy ..... 280/14.22

FOREIGN PATENT DOCUMENTS

DE 196 19 676 A1 7/1997

OTHER PUBLICATIONS

WO 97/18016, Publication Date May 22, 1997, Snowboard Boot Retaining Device Enabling a Boot to Tilt Sideways Relative to the Board.

* cited by examiner

*Primary Examiner*—Brian L. Johnson
*Assistant Examiner*—J. Allen Shriver
(74) *Attorney, Agent, or Firm*—Rankin, Hill, Porter & Clark LLP

(57) ABSTRACT

A spacer for snowboards which, in the region between the snowboard boot (22) and the snowboard (20), in addition to the snowboard binding (21), provides a non-positive connection between the snowboard boot (22) and the snowboard (20) and contributes to enlarging of the bearing surface(s) (4.1, 4.2).

11 Claims, 5 Drawing Sheets

SPACER

BACKGROUND OF THE INVENTION

1. Field of the Invention

The invention presented here relates to a spacer and to a screw extension for snowboard bindings.

2. Description of Related Art

When riding snowboards, it is important that the contact between the snowboard and the snowboard boot is as direct as possible so that the rider is immediately in a position to react to the movements of the snowboard and can apply the steering forces as efficiently as possible. The bindings and boot systems known in the art manifest significant disadvantages in this respect. Consequently, force transmission and the damping characteristics between the snowboard and the snowboard boot, and/or the rider, are not optimal.

The bindings currently in use are, as a rule, fixed by means of screws to screw inserts disposed in the middle of the snowboard for this purpose. As a result, the forces are transmitted at a few, tightly restricted points between the snowboard and the binding. The steering forces in particular, however, typically act on the edge regions of the snowboard. For their part, they are in equilibrium with the corresponding reaction forces of the rider, which are in the main transmitted at the tip and at the heel of the boot. In the case of the binding and boot systems known today, these forces are, due to the above-referenced design, transmitted through the few, tightly restricted fixing points, which are located in the middle of the snowboard. This contravenes the fact that the regions in which the forces are generated, namely the tip and the heel of the snowboard boot, and the regions in which the forces are transmitted to the substratum, namely edge regions of the snowboard, are directly above one another.

In the case of the bindings known from prior art, the load paths are very long, because the forces are conducted through the middle of the snowboard, where the fixing points are situated. Because only few regions transmit the forces, these are in addition massively concentrated. Through this concentration in the middle of the snowboard, high forces are generated, which produce material fatigue. This, in turn, has a negative effect, particularly on the useful lifetime of the material. Excessively long load paths, because of the elasticity of the material and the poor damping between the snowboard and the snowboard boot, lead to undesirable vibrations. As a result, the rider perceives an insecure, spongy feeling. Apart from this, the required expenditure of force is unnecessarily high and the application of the force is delayed, because the long load paths always have to be deformed first, before the steering forces are transmitted to the edges of the snowboard. The binding plates customary today are very hard and permit practically no deformations. This, in turn, leads to the fact that the rigidity characteristic of a snowboard is lastingly and negatively affected with a directly mounted binding plate.

Various snowboard bindings are known in the art. In the document PCT/US98/06773, for example, a snowboard with adjustable stiffening elements is described. The stiffening elements serve to influence the rigidity and the torsional characteristics of the snowboard and are fixed to the snowboard by means of reversibly releasable connections. From CH 677 191, a snowboard binding is known. This consists of an element, which is connected with the snowboard through a central fixing device. PCT/EP96/02980 divulges a further binding for snowboards, in the case of which also the fixation and with this the transmission of the forces between snowboard and rider takes place in the middle of the snowboard. From FR 2 740 983, a binding for snowboards is known, the base plate of which is directly fixed to the snowboard. The transmission of the forces takes place in the middle of the snowboard. U.S. Pat. No. 5,520,405 shows a further binding for snowboards with a bayonet type lock. Affixed to the snowboard boots at the front and back are supports, which serve as walking aids.

From DE 196 19 676, a plate for snowboard bindings is known. This consists of a middle part, which is located at the center of two ring-shaped lateral parts, which are arranged concentrically one above the other. The lateral parts can be connected together, one above the other, in different angular positions such that the angle between a binding and a snowboard is variable.

A further problem in the case of the snowboard binding and boot systems consists in those parts that protrude beyond the snowboard. When making curves and when the snowboard is placed on its edge to make curves, the protruding parts have a tendency to get caught in the substratum, which can lead to serious falls or unwanted braking.

SUMMARY OF THE INVENTION

It is an objective of the invention presented here to eliminate or minimize the problems in prior art by means of a spacer and a screw extension. The spacer is to be compatible with the snowboards and snowboard bindings known from prior art. The long, disadvantageous load paths and the poor damping are to be avoided. The expenditure of force necessary for riding is to be reduced and a direct-acting contact between the snowboard and the snowboard boot with short load paths is to be furthered.

The invention divulged here comprises a spacer, which is utilized in combination with the known snowboards and snowboard bindings, is compatible with the different connections and solves the problems associated with prior art. The spacer is designed such that it is not dependent on a single type of binding and that it can be utilized with several types of binding without any particular effort.

The spacer is in an active combination with the snowboard and/or with the snowboard binding and/or with the snowboard boot, so that the forces generated are optimally transmitted between their point of origin and their point of effect. As a result of the locating of the spacer in the region of the binding plate, the bearing area for the snowboard boots, particularly in the case of narrow snowboards or snowboards having surface indentations, is purposefully enlarged. On the other hand, the distance between the snowboard boot and the snowboard is increased in an advantageous manner. This has the effect of a better load introduction into the snowboard and/or into the snowboard boots and, especially in the case of making curves, makes a better build-up of pressure between the edges and the substratum possible. The reaction from the snowboard, and the interaction between the rider and the snowboard, is purposefully enhanced. Apart from this, the excessively long load paths between the snowboard boot and the snowboard with their negative effect are avoided. In addition, dangers posed by parts of the boot protruding beyond the edges of the snowboard is reduced. In order to assure an ergonomical, natural position of the foot, the angle between the bearing surface for the snowboard boots and the gliding surface of the snowboard can be adjusted, if so required. As a result of this, the different riding habits and riding styles are optimally taken into account and the danger of tensing up is reduced to a minimum.

Through the spacer divulged here, the expenditure of force necessary for riding the snowboard is purposefully reduced. This is, because as a result of the increased distance between the snowboard and the snowboard boots on the one hand and the increased contact surface on the other hand, the effective leverage for the transmission of the force increases, which leads to an increasing of the effective steering forces. This has a particularly positive effect on the riding characteristics. A further function of the invention divulged here consists in an improved damping between the snowboard boots and the snowboard. This has the consequence that the shocks and vibrations harmful for the rider are purposefully reduced and the snowboard, in case of a fast ride, has less of a tendency to flutter. Because of this, the rider is given the feeling of a safe ride, because a direct contact between the snowboard and the rider is guaranteed. The load introduction, this as a difference to prior art, is not anymore restricted to a few points, but rather more takes place over an area. This leads to the fact that the forces are more evenly distributed and a harmful concentration, which would lead to material fatigue, is avoided. In addition, the spacer preferably has an as neutral as possible characteristic in comparison with the rigidity of the snowboard and, therefore, in contrast to the today, in part customary, very hard binding plates, has a controlled effect on the rigidity.

The spacer divulged here advantageously is made of several parts and is adjustable, so that a compatibility with various snowboards and snowboard bindings available on the market is achieved. After the release of certain fixing means, the individual parts can be moved relative to one another within a defined range and, therefore, can be specifically adapted to the corresponding requirements and riding styles. This results in a, to the greatest extent, independence of the required snowboard and/or binding types. This adaptability to different types of snowboard and/or binding is effected in particular through moving the parts, as a result of which the width of the spacer is variably adaptable to the board width of different snowboards, such as, for example, freestyle and alpine boards. The spacer furthermore is compatible with the customary standard hole patterns of snowboard bindings, such as 4×4 and 3×3, as well as with the customary connection surfaces of soft, alpine, and step-in bindings. In particular, because of the fact that it is made of several parts and is adaptable, the spacer is also suitable for snowboards that do not have an even surface on their top side.

BRIEF DESCRIPTION OF THE DRAWINGS

In the following, the invention is described in detail on the basis of Figures. These illustrate.

DETAILED DESCRIPTION OF THE PREFERRED EMBODIMENTS

Figure 1:
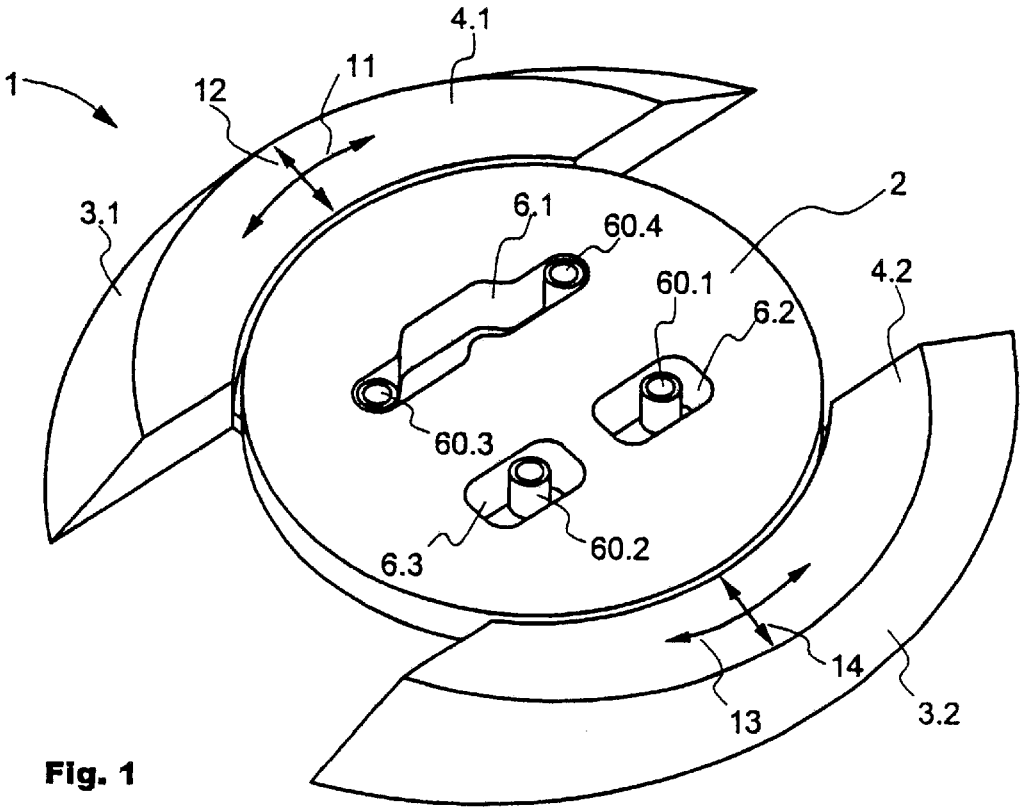
FIG. 1 is a perspective view of a preferred embodiment of a spacer according to the present invention.

FIG. 1 illustrates an example of an embodiment of a spacer 1 in accordance with the invention made of several parts in an oblique perspective view from above. The spacer 1 here comprises a middle part 2 and two lateral parts 3.1 and 3.2 with bearing surfaces 4.1 and 4.2, which preferably have a non-slip surface coating. The spacer 1 according to the invention is installed between a snowboard boot 22 and a snowboard 20 (as shown in FIG. 3) such that a non-positive connection with the short load paths between the snowboard 20 and the snowboard boot 22 results. The lateral parts 3.1 and 3.2 and the middle part 2 advantageously are made of plastic materials (e.g.: polyamide, polycarbonate, polyurethane), fibre-reinforced plastic materials, foamed materials, metals or similar suitable materials or combinations thereof. The individual component parts of the spacer 1 can be made of different materials. The lateral parts 3.1 and 3.2 and/or the middle part 2 can comprise recesses or reinforcing ribs or advantageously consist of layers made out of several materials, which additionally purposefully reinforce the damping and stability characteristics and contribute to a saving in materials and in weight and to the damping of vibrations. Elastomeres or equivalent materials are in particular suitable for the damping of shocks and vibrations. Vibrations in the case of a construction with several layers are advantageously damped by purposefully applied friction, in particular between the individual layers.

The installation of the spacer 1 is carried out through means of fixing, in preference openings 6.1, 6.2, 6.3, which correspond with the bores, respectively, with the bore pattern of several snowboard bindings and the threaded inserts of the snowboards 20 available on the market. In order to achieve an optimum compatibility of the spacer 1 with the snowboards and snowboard bindings available on the market, a screw extension 60.1 to 60.4 for installation screws was developed (FIG. 5), which simplifies the installation of the spacer 1. A possible arrangement of the screw extensions 60.1 to 60.4 is schematically illustrated here.

The lateral elements 3.1 and 3.2, when the fixing screws of the snowboard binding 21 are released (refer to FIG. 3), are movable relative to the middle part 2 in the direction of the arrows 11, 12, 13 and 14 within a defined range and in preference steplessly and independently. The spacer 1 in this manner is specifically adjusted to the differing sizes of snowboard boots 22 (refer to FIG. 3) and angles of the snowboard binding 21 (refer to FIG. 3) to the direction of travel. Apart from this, as a result of the movability of the regions, through which the forces are transmitted to the snowboard 20, these can be purposefully adjusted, respectively, displaced. By tightening the fixing screws (not illustrated in detail) for the snowboard binding 21 (refer to FIG. 3), here the lateral elements 3.1 and 3.2 and the middle part 2 are locked in position. If so required, certain surfaces of the spacer 1 are partially or completely provided with an anti-friction surface coating or with equivalent elements, so that between the bearing surfaces of the spacer 1 and the snowboard boot 22 (refer to FIG. 3) and/or between the bearing surfaces of the spacer 1 and the snowboard 20 (refer to FIG. 3) an increased static friction exists. As a result of this, among other things the stepping into the snowboard binding 21 is made easier (refer to FIG. 3). The lateral parts 3.1 and 3.2 are adjustable relative to the middle part 2. This makes it possible to displace the load introduction into the snowboard 20 (refer to FIG. 3). The spacer advantageously is designed such that snow is not able to heap up against it in a disruptive manner, which would have a negative effect on the handling.

Figure 2:
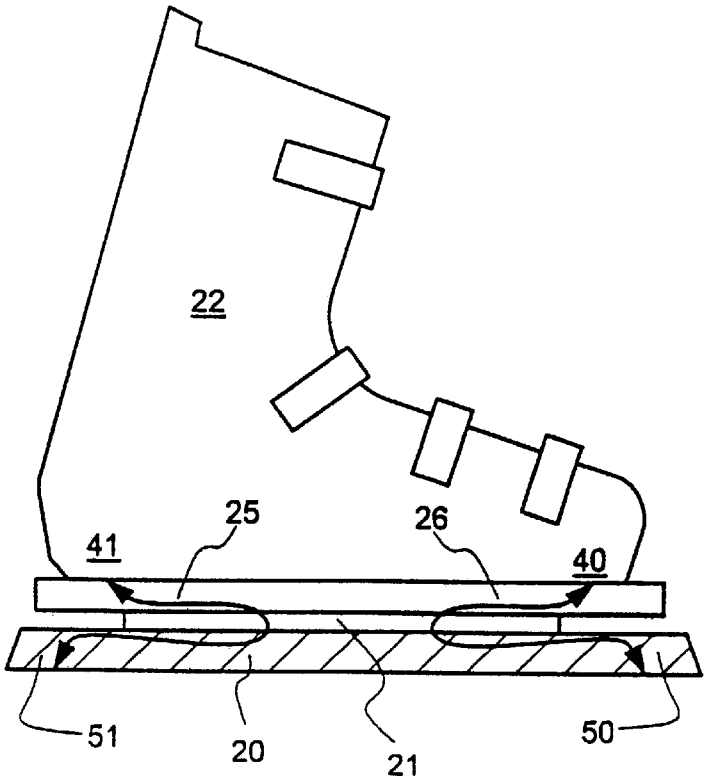
FIG. 2 illustrates a typical arrangement of snowboard, binding plate and snowboard boot according to prior art.

FIG. 2 schematically illustrates a typical arrangement today of a snowboard boot 22 on a snowboard 20 according to prior art. This is a cross-section view through the snowboard 20 approximately vertical to the direction of travel. A snowboard binding 21 connects the snowboard boot 22 with the snowboard 20. Load paths 25 and 26 illustrate the approximate route of the forces between a tip 40 of the snowboard boot 22, respectively, the heel 41 of the snowboard boot, and edge regions 50 and 51 of the snowboard 20. Identifiable is the long detour of the load paths 25, 26 through the snowboard binding 21.

Figure 3A:
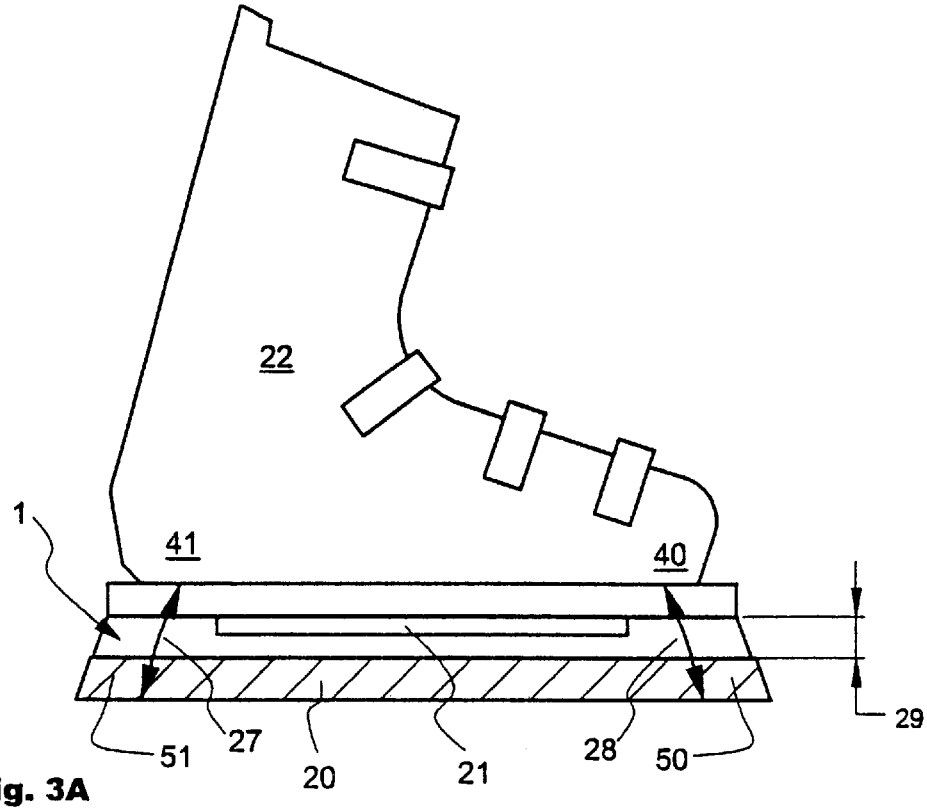
FIG. 3A illustrates a portion of a first preferred embodiment of the spacer according to the present invention in an installed condition.

FIG. 3A schematically illustrates a method of functioning of the spacer 1 in accordance with the invention. The direction of view corresponds to that of FIG. 2. The spacer 1 is designed such that it is capable of being integrated as a non-positive connection between the snowboard binding 21, the snowboard boot 22 and the snowboard 20. In comparison with the arrangement according to FIG. 2, without a spacer 1 and with only the snowboard binding 21, by the adding of the spacer 1 an enlargement of the bearing surfaces and of the surfaces for the introduction of the loads into the snowboard 20 comes about. The now active load paths 27 and 28, in comparison with the load paths 25 and 26 depicted in FIG. 2, are very short and adjustable. As a result of this, the steering forces are purposefully conducted from their place of origin, the tip 40, respectively, the heel 41 of the snowboard boot 20 to their destination, namely the edge regions 50 and 51 of the snowboard 20. The material of the spacer 1 has a purposeful influence on the forces transmitted through the load paths 27 and 28. On the one hand, the forces are more evenly distributed and introduced into the snowboard 20 through a larger surface area. On the other hand, however, the forces are also damped. This has the effect that the shocks and vibrations harmful for both the rider and for the material are purposefully influenced, as compared to the arrangement without a spacer 1 (in accordance with FIG. 2). Through the selection of the materials for the individual parts of the spacer 1 and their combination, the shocks and the vibrations of the snowboard 20 are modified. In achieving this, advantageously two types of friction come into operation. On the one hand, external friction and on the other hand, internal friction. External friction is the friction between the various contact surfaces foreseen for this purpose, this in particular in the case of a construction with different layers. Internal friction is the destruction of dynamic energy in materials suitable for this. Elastomeres or functionally equivalent materials are particularly suitable for this purpose.

The load paths 27 and 28 in accordance with the invention can also take a different route to the one illustrated here. However, in any case the load paths completely or partly pass through the spacer 1. The frictional connection between the snowboard boot 22 and the snowboard 20 advantageously acts in the region of the tip 40 of the snowboard boot 22 and in the region of the heel 41 of the snowboard boot 22.

Because of the spacer 1, the distance 29 between the snowboard boot 22 and the snowboard 20 is increased. This increase has the effect that parts of the snowboard binding 21 or of the snowboard boot 22, in particular when making curves, have a reduced tendency to get caught in the substratum. The ground clearance additionally gained as a result of this, on the one hand enables greater inclinations when making a curve and, on the other hand, consciously reduces the expenditure of force necessary when riding, resp., to make possible a greater build-up of pressure. This is the case because the effective lever arm (leverage) is longer and the build-up of the force in the edges 50 and 51 is optimized. The effect of the leverage is adjusted through the thickness of the spacer 1. The snowboard binding 21 in the illustrated embodiment illustrated does not have any direct contact with the snowboard 20. The spacer 1 has a positive effect, particularly in the case of the narrower and narrower snowboards of today, which in turn improves the maneuverability.

Figure 3B:
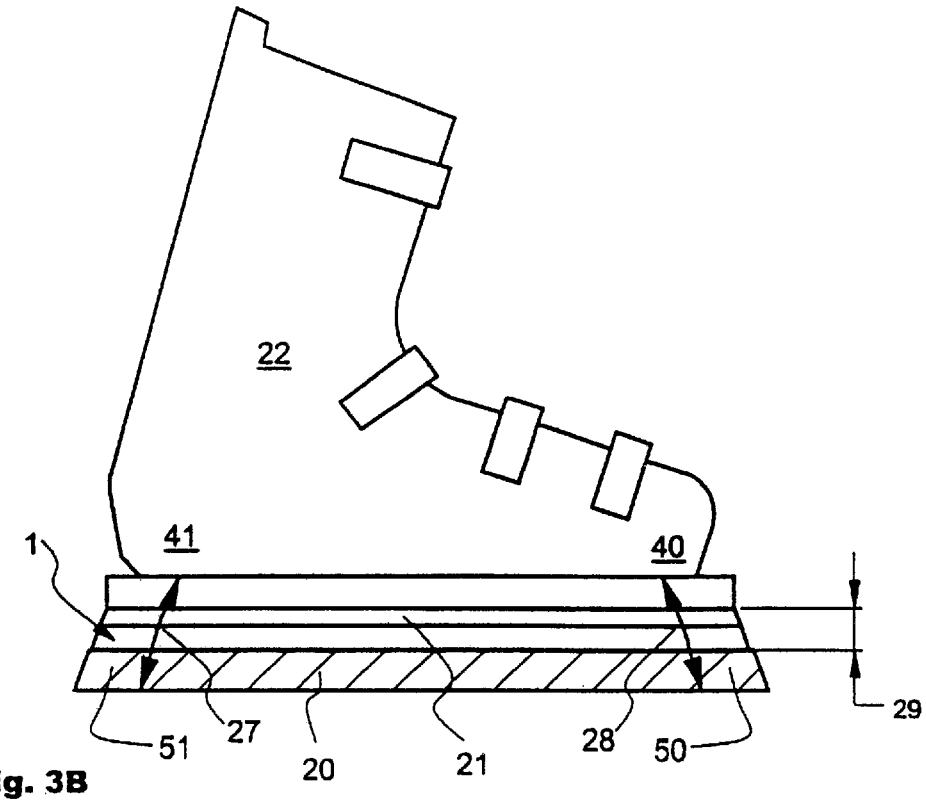
FIG. 3B illustrates a portion of another preferred embodiment of the spacer according to the present invention in an installed condition.

FIG. 3B depicts a further embodiment of a spacer 1. The spacer 1 illustrated here is not in a direct connection with the snowboard boot 22, but rather is connected with it with respect to its action through the snowboard binding 21. The spacer 1 distributes the forces and torques transmitted to it from the snowboard binding 21 to the snowboard 20 over a large surface area. As a result of its construction according to the invention, the spacer 1 in particular makes a contribution to the damping and absorption of harmful and undesirable shocks and vibrations. Apart from this, it increases the distance 29 between the snowboard 20 and the snowboard boot 22.

Figure 4:
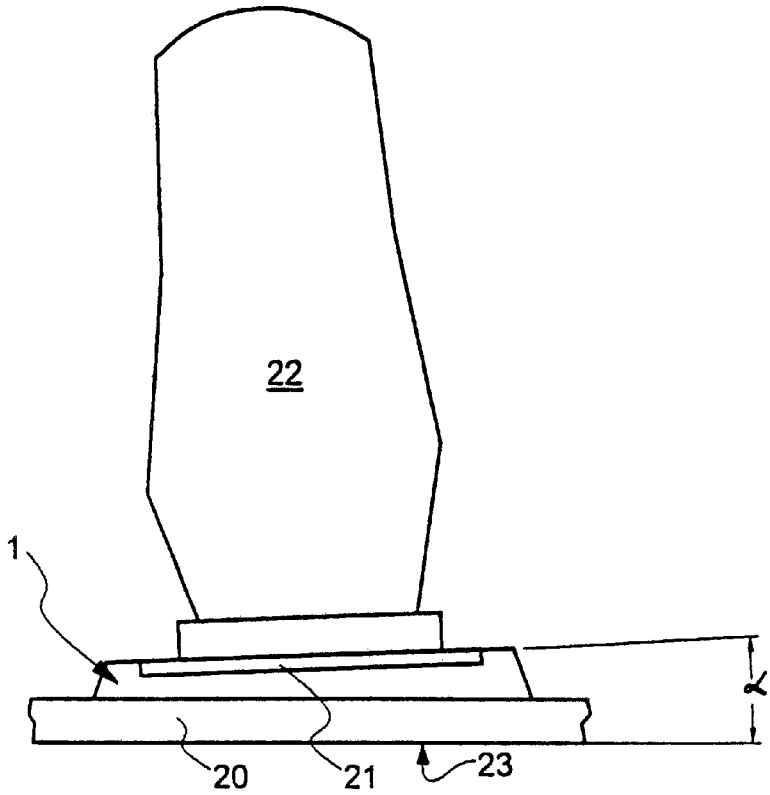
FIG. 4 illustrates a portion of another preferred embodiment of the spacer according to the present invention, the spacer having an adjustable angle.

FIG. 4 illustrates a preferred embodiment of a spacer 1 with the snowboard 20, the snowboard binding 21 and the snowboard boot 22 approximately in a rear view. Depicted of the snowboard 20 is solely a section, which is emphasized by the jagged edges. The embodiment of the spacer 1 depicted here has the effect, that the snowboard boot 22 is inclined to a sliding surface 23 of the snowboard 20 at an angle $\alpha$. The inclination of the snowboard boot 22 in this is not, as is depicted here, restricted to a purely lateral inclination. The angle $\alpha$ can be purposefully changed, in order that individual requirements, habits and riding styles can be satisfied. By means of this adaptability, an ergonomical stance of the rider on the snowboard 20 can be achieved in which the feet assume a natural position. As a result, it is possible to avoid physical distortions that may lead to the rider tensing-up. In principle, two different variants of the angle adjustment are to be differentiated between. In the case of first variant, the angle $\alpha$ is defined by the geometry of the spacer 1. In the case of the second variant, the spacer 1 is designed such that the angle $\alpha$ can be adjusted at any time to the desired value by the adding of additional elements, for example by the underlaying of wedge elements (not shown in more detail), or by means of a variable geometry of the middle part 2 and/or of the lateral parts 3.1 and 3.2 (not illustrated in more detail). Suitable for this purpose in particular is a sphere-shaped or cylinder-shaped supporting of the middle part 2 and/or of the lateral parts 3.1 and 3.2 in corresponding bearing counterparts (not depicted in more detail).

Figure 5:
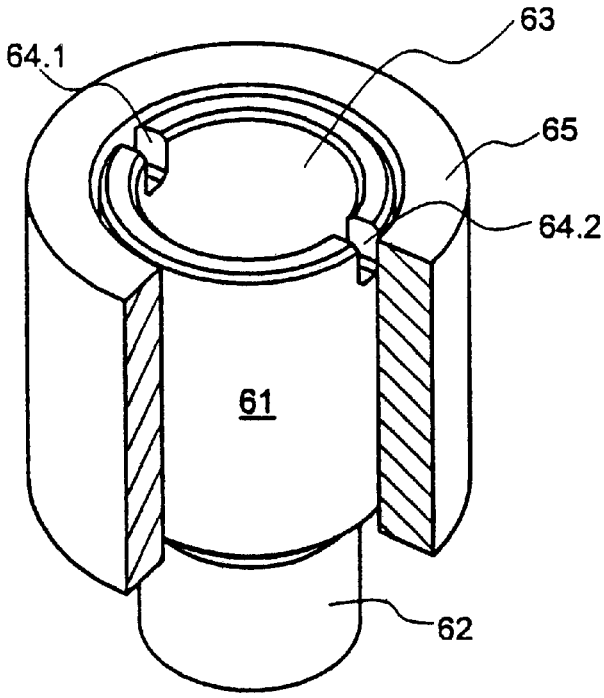
FIG. 5 is a perspective view, with portions removed for clarity, of a screw extension in accordance with the present invention.

FIG. 5 depicts a preferred embodiment of a screw extension 60, which is used for the installation of the spacer 1. This screw extension 60 serves to increase the length of the fixing screws (not illustrated in more detail) for the snowboard binding 21. It bridges the distance 29 created by the spacer 1 between the snowboard boot 22, respectively snowboard binding 21, and the snowboard. The screw extension 60 comprises a pin 61 and a rotating part 65 that surrounds the pin 61. The rotating part 65 is designed such that it rests on the respective threaded insert (not illustrated in more detail) in the snowboard 20 and protects it against being pulled out. The pin 61, at one end, comprises an external thread 62 and, at the other end, an internal thread 63. The screw extension 60 during the installation of the spacer 1 is screwed into the threaded inserts of the snowboard 20 foreseen for the installation of the binding, so that after the spacer 1 has been placed on top once again a bore pattern suitable for the installation of the snowboard binding 21 is present on the opposite side of the spacer 1. Grooves 64.1 and 64.2 permit the screw extension 60 to be screwed-in by means of a screwdriver.

Figure 6A:
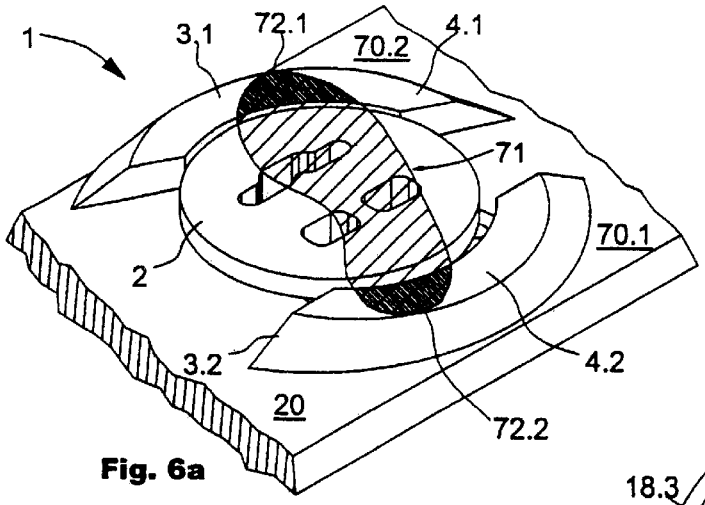
FIG. 6*a* illustrates,the arrangement of a bearing surface of a boot on a spacer.

FIG. 6*a* depicts a spacer 1 in accordance with FIG. 1 in an oblique perspective view from above. The spacer 1 is installed on a snowboard 20 such that the lateral elements 3.1 and 3.2 assure an optimum load introduction into lateral edge regions 70.1 and 70.2. This is assured in the case of any combination of commercially available snowboards and bindings by the lateral parts 3.1 and 3.2, which are adjustable relative to the middle part 2. A typical position of a snowboard boot (not illustrated in more detail) is schematically represented by a hatched area 71. Inside the hatched area 71, two more densely hatched areas 72.1 and 72.2 are identifiable, which are situated in the region of the contact zones between the lateral elements 3.1 and 3.2 and a snowboard tip, respectively, a snowboard heel. These schematically represent the zones of the primary transmission of forces between the snowboard boot (not depicted in more detail) and the spacer 1. The forces, which in these regions act upon the lateral elements 3.1 and 3.2, are transmitted to the snowboard 20 over a large surface area through the lateral elements 3.1 and 3.2, which are designed with a sickle shape. By the construction of the load-transmitting lateral elements it is achieved that such harmful shocks and vibrations are reduced between the snowboard boot 22 and the snowboard 20 and/or in the snowboard 20.

Figure 6B:
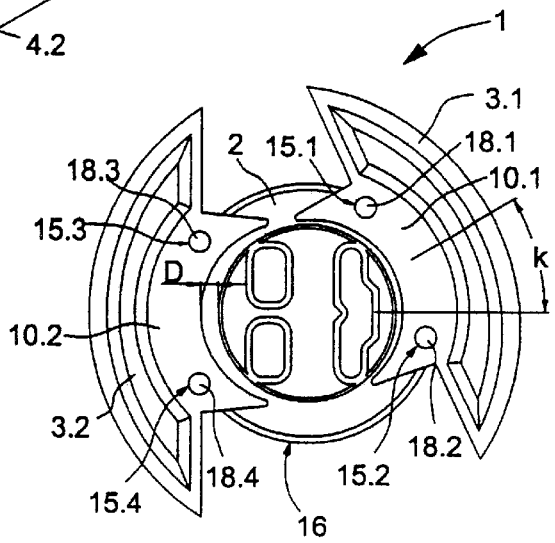
FIG. 6*b* is a bottom plan view of a spacer as shown in FIG. 6*a;*

FIG. 6*b* illustrates the spacer 1 according to FIG. 6*a* in a view from underneath. To be identified are the middle part 2 and the lateral elements 3.1 and 3.2. The lateral elements 3.1 and 3.2, in comparison with the representation in FIG. 1, are displaced by an angle k (3.1) and by a distance D (3.2). Naturally, the parts 3.1 and 3.2 are also lockable in any other position required. The lateral elements 3.1 and 3.2 in the illustrated embodiment comprise fishplates 10.1 and 10.2 with openings 15.1, 15.2, 15.3, and 15.4. These fishplates 10.1 and 10.2 extend underneath an edge 16 of the middle plate 2. With the fixing screws of the snowboard binding (not illustrated in more detail) released, the lateral elements 3.1 and 3.2 are adjustable in the direction of the arrows 11, 12, 13 and 14 (refer to FIG. 1) to any position required. By tightening the fixing screws of the snowboard binding, the edge of the middle part is pressed against the fishplates 10.1 and 10.2. As a result, these are locked against any unwanted displacement. An additional fixation is achieved here through elastically deformable elements 18.1, 18.2, 18.3, and 18.4, which are embedded in the openings 15.1, 15.2, 15.3, and 15.4. These advantageously are made out of rubber, cellular rubber or similar materials and in the non-deformed condition have a greater thickness than the fishplates 10.1 and 10.2. Further means prevent an unwanted falling out of the lateral elements 3.1 and 3.2. A more detailed description will be found in the text relating to FIG. 8.

Figure 7:
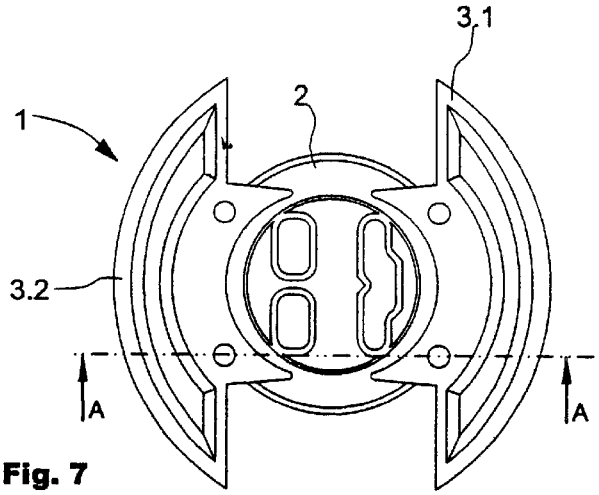
FIG. 7 illustrates a symmetrically arranged spacer from underneath.

FIG. 7 depicts the spacer of FIG. 1 from underneath. Identifiable are the middle part 2 and the lateral elements 3.1 and 3.2, which here are arranged symmetrically to the middle part 2. The lateral elements 3.1 and 3.2 here comprise recesses. The lateral elements 3.1, 3.2 can also be composed of different materials arranged in layers or comprise ribs and other elements. Through the special construction and shape it is determined at which points a purposeful introduction of the load into the snowboard takes place. The lateral elements 3.1 and 3.2 advantageously are separately interchangeable so that particular requirements and demands, in particular concerning the different snowboard binding systems and snowboards, are fulfilled.

Figure 8:
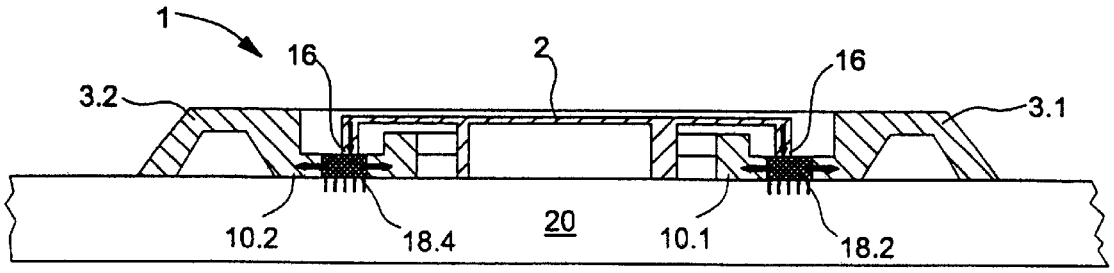
FIG. 8 is a cross-sectional view of the spacer as seen along line A—A of FIG. 7.

FIG. 8 illustrates a sectional view of the spacer of FIG. 7 as seen along a section line A—A, which runs through the middle of the elastically deformable elements 18.2 and 18.4. The representation illustrated here shows the spacer 1 fixed on a snowboard 20. The fixing screws (not depicted in more detail) of the snowboard binding (refer to FIG. 1) are tightened, so that the fishplates 10.1 and 10.2 are clamped between the edge 16 of the middle part 2 and the surface of the snowboard 20. The openings 15.2 and 15.4 (15.1 and 15.3 equivalent) are arranged such that they are lying within the active zone of the edge 16. As a result of this, the elements 18.2 and 18.4 (18.1 and 18.3 equivalent) are pressed against the surface of the snowboard by the edge 16 and thus locked against any lateral displacement. Through this arrangement, the lateral elements 3.1 and 3.2 are locked in their position. The adjustable ranges of the lateral elements 3.1 and 3.2 are selected such that the independence of the snowboard binding type and snowboard type is optimally taken into account. The disadvantages of the snowboard bindings and snowboards known from prior art are avoided by the combination with the spacer 1 divulged in this document.

Figure 9:
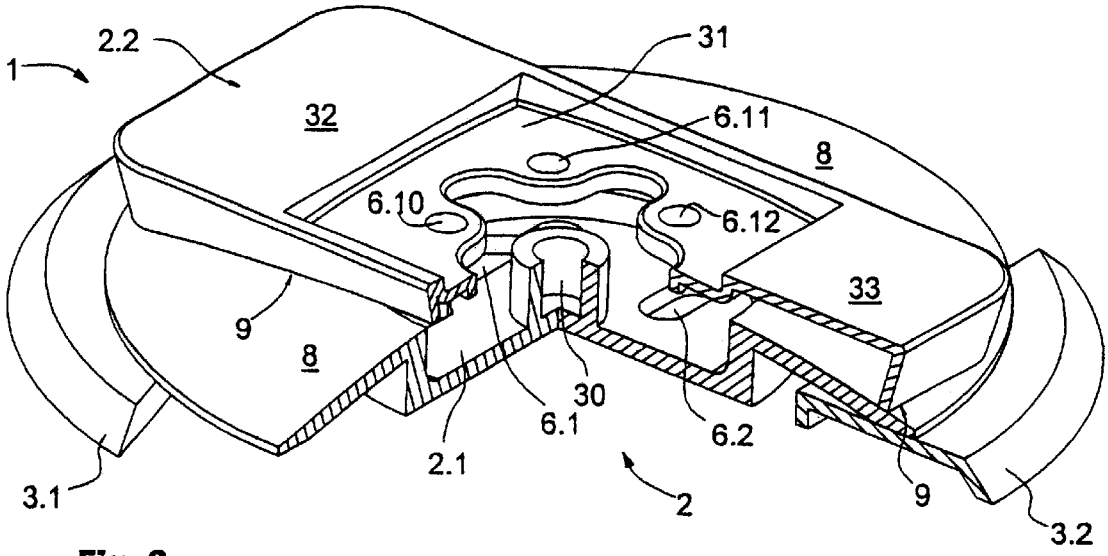
FIG. 9 is a perspective view, with portions removed for clarity, of a further preferred embodiment of the spacer; and, FIG. 10 illustrates a spacer according to the FIGS. 1 and 6 with a shell binding.

FIG. 9 illustrates a further preferred embodiment of a spacer 1, in the case of which the angle $\alpha$, between the snowboard boot 22 and the snowboard 20 (refer to FIG. 4) is adjustable. The spacer 1 for the purpose of a better understanding is here depicted in a sectional view. The spacer 1 comprises two lateral parts 3.1 and 3.2 and the middle part 2, which here consists of the two parts 2.1 and 2.2. The two parts 2.1 and 2.2 here each comprise a surface with a spherical shape 8, 9. These two surfaces correspond with one another such that the part 2.2 is displaceable relative to the part 2.1 in a not fixed condition. In order to lock the two parts 2.1 and 2.2 reversibly releasable relative to one another, the element 2.1 has a threaded opening 30, in which a fixing element (not illustrated in more detail here) is anchored. The fixing element acts on a surface 31 of the part 2.2 here, which also has a spherical shape. The part 2.1 is fixed on a snowboard (not depicted in more detail) through means of fixing, here openings 6.1 and 6.2, in analogy to the description of the FIG. 1. A snowboard binding (not illustrated in more detail) is fixed onto the part 2.2 by means of corresponding fixing elements, here the openings 6.10, 6.11, and 6.12). Through surfaces 32 and 33, in accordance with the invention an active connection between a snowboard boot tip (not depicted in more detail), resp., a snowboard boot heel (not depicted in more detail) and a snowboard (not illustrated in more detail) is achieved. The spacer 1 is designed such that the angle $\alpha$ (refer to FIG. 4) is adjustable in all directions to comply with the requirements. The lateral parts 3.1 and 3.2 are fixed in analogy to the embodiment described in FIG. 8.

Figure 10:
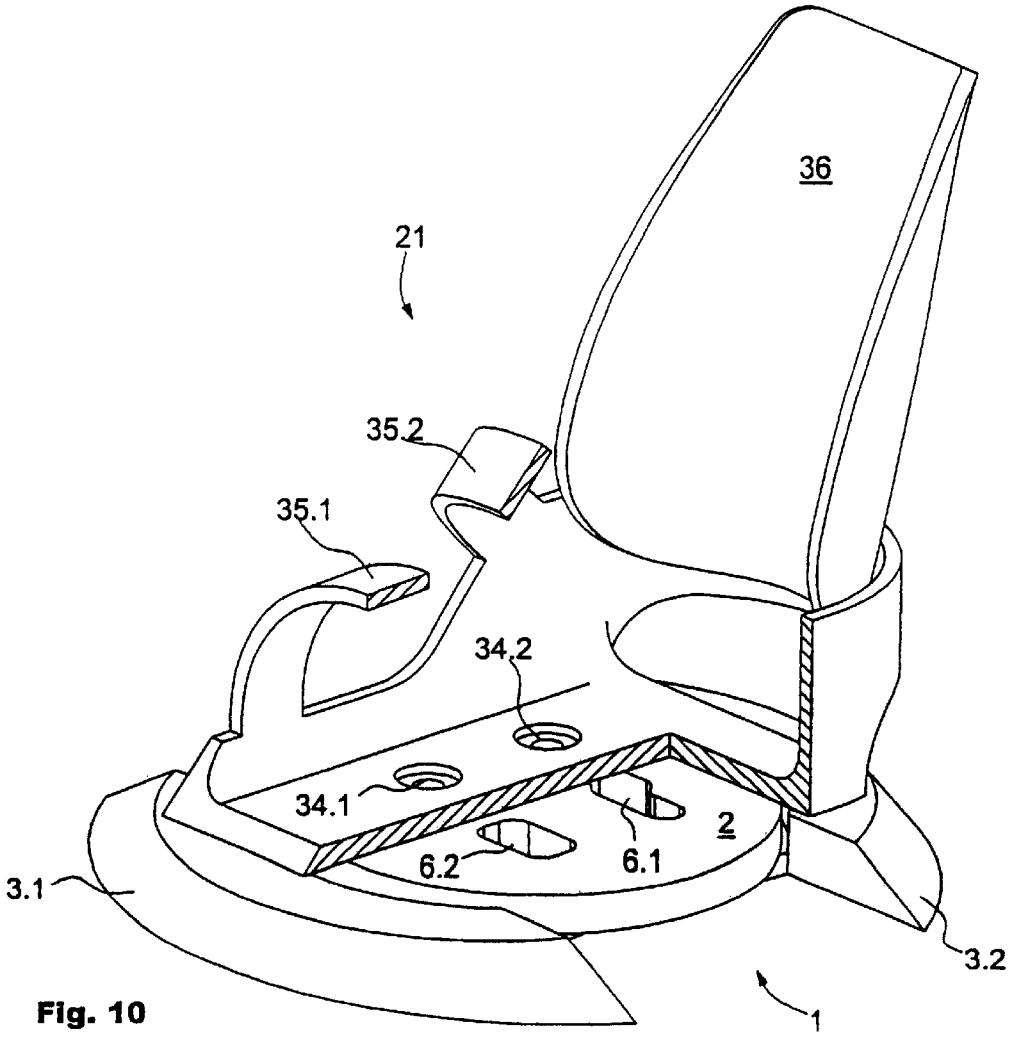

FIG. 10 depicts a spacer 1 according to FIG. 1 with a commercially available snowboard shell binding 21

(sectional view). The lateral parts 3.1 and 3.2 and the middle part 2 here in contrast to the arrangement illustrated in FIG. 8 have the same height, so that the shell binding is securely supported in particular on the lateral parts 3.1 and 3.2 and so that short load paths are guaranteed. The spacer 1 is designed such that differing lateral parts 3.1, 3.2 and middle parts 2 can be compatibly connected together and are interchangeable. As can be identified here, the openings 6.1, 6.2, 6.3 (refer to FIG. 1) correspond with the openings 34.1 and 34.2 of the snowboard shell binding 21 foreseen as means of fixing, so that a secure fixation with a snowboard (not depicted in more detail) is guaranteed. On the basis of the adjustability in accordance with the invention (refer to FIG. 1) of the lateral parts 3.1 and 3.2 of the spacer 1, the spacer 1 as is illustrated here can be adjusted such that no parts of the snowboard binding 21 protrude or extend beyond the edges of the snowboard in endangered regions. The spacer 1, in particular, is designed such that the forces and torques introduced from holding strips 35.1 and 35.2, resp., from a shell 36 are transmitted to a snowboard binding (not illustrated in more detail) and introduced into the snowboard in particular through the lateral parts 3.1 and 3.2, resp., the middle part.

For the expert with the knowledge of the invention divulged here it is clear, that this invention is also applicable to other fields, in particular also to other sliding boards.

What is claimed is:

1. A spacer (1) with a middle part (2) that comprises means (6.1, 6.2, 6.3) for affixing different commercially available snowboard bindings (21) to a snowboard, and with lateral parts (3.1, 3.2) which, as spacers between a snowboard (20) and a snowboard boot (22), are arranged such that they result in a connection between one of a tip (40) and a heel (41) of the snowboard boot (22) and the snowboard (20), wherein the middle part (2) is located between several lateral parts (3.1, 3.2) that are releasable and which, when in a released condition, are movable around the middle part (2) and relative to said middle part (2) in a radial distance (D, 11, 12, 13, 14) and comprises means (15.1, 15.2, 15.3, 15.4, 16, 18.1, 18.2, 18.3, 18.4) for affixing ofthe lateral parts (3.1, 3.2) relative to the middle part (2) in adjustable positions.

2. The spacer (1) in accordance with claim 1, wherein the middle part (2) comprises openings (6.1, 6.2, 6.3) that simultaneously coincide with bore patterns of different commercially available snowboard bindings (21).

3. The spacer in accordance with claim 1, wherein the middle part (2) has a circular horizontal projection and the lateral parts (3.1, 3.2) have a sickle-shaped horizontal projection.

4. The spacer in accordance with claim 1, wherein the middle part (2) has a lesser thickness than the lateral parts (3.1, 3.2).

5. The spacer in accordance with claim 1, wherein the lateral parts (3.1, 3.2) comprise fishplates (10.1, 10.2) which, for the purpose of fixing the lateral parts (3.1, 3.2), are clampable between an edge (16) of the middle part (2) and the snowboard (20).

6. The spacer in accordance with claim 5, wherein the fishplates (10.1, 10.2) have openings (15.1, 15.2, 15.3, 15.4) with elastic elements (18.1, 18.2, 18.3, 18.4) that are clampable between the edge (16) of the middle part (2) and the snowboard (20) and which serve for the lateral locking of the lateral elements (3.1, 3.2).

7. The spacer in accordance with claim 1, wherein at least one of the middle part (2) and the lateral parts (3.1, 3.2) have a variable geometry such that an angle ($\alpha$) between a bearing surface (4.1, 4.2) for the snowboard boot (22) and a sliding surface (23) of the snowboard (20) is adjustable.

8. The spacer in accordance with claim 1, wherein the spacer (1) is formed from a material selected from the group consisting of polyamide, polycarbonate, polypropylene and polyethylene.

9. A screw extension (60) through the means for affixing opening (6.1, 6.2, 6.3) of the middle part (2) of the spacer (1) in accordance with claim 1, wherein the screw extension (60.1, 60.2, 60.3, 60.4) comprises a pin (61) with an internal (63) and an external thread (62) and a rotating part shaped like a bushing.

10. The screw extension (60) in accordance with claim 9, wherein the rotating part (65) belonging to the pin (61) is designed such that in the installed condition it rests on the threaded insert in the snowboard (20) and protects the said insert against being pulled out.

11. A snowboard (20) with a snowboard binding (21), wherein a spacer is located in a region of the snowboard binding (21), said spacer having a middle part (2) that comprises means (6.1, 6.2, 6.3) for affixing different commercially available snowboard bindings (21) with a snowboard, and with lateral parts (3.1, 3.2) which, as spacers between a snowboard (20) and a snowboard boot (22), are arranged such that they result in a connection between one of a tip (40) and a heel (41) of the snowboard boot (22) and the snowboard (20), wherein the middle part (2) is located between several lateral parts (3.1, 3.2) that are releasable and which, when in a released condition, are movable around the middle part (2) and relative to said middle part (2) in a radial distance (D, 11, 12, 13, 14) and comprises means (15.1, 15.2, 15.3, 15.4, 16, 18.1, 18.2, 18.3, 18.4) for affixing of the lateral parts (3.1, 3.2) relative to the middle part (2) in adjustable positions.

* * * * *

UNITED STATES PATENT AND TRADEMARK OFFICE

CERTIFICATE OF CORRECTION

PATENT NO. : 6,505,841 B1 
DATED : January 14, 2003
INVENTOR(S) : Kessler et al.

It is certified that error appears in the above-identified patent and that said Letters Patent is hereby corrected as shown below:

Column 9,
Line 40, delete “ofthe” and insert -- of the --.

Column 10,
Line 23, before “(6.1, 6.2, 6.3)”, delete “opening”.

Signed and Sealed this

Twenty-seventh Day of May, 2003

JAMES E. ROGAN
*Director of the United States Patent and Trademark Office*